US007559434B2

(12) United States Patent
Masting

(10) Patent No.: US 7,559,434 B2
(45) Date of Patent: Jul. 14, 2009

(54) PACKAGING TWO DIFFERENT SUBSTRATES

(75) Inventor: Daniel Fraser Masting, Hove (GB)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 12/012,582

(22) Filed: Feb. 4, 2008

(65) Prior Publication Data

US 2008/0124382 A1 May 29, 2008

Related U.S. Application Data

(62) Division of application No. 10/324,860, filed on Dec. 20, 2002, now Pat. No. 7,354,598.

(51) Int. Cl.
*B65H 1/00* (2006.01)

(52) U.S. Cl. ..... 221/34; 221/45; 221/46; 221/33; 221/63; 221/92; 206/233; 206/494; 206/581; 206/812

(58) Field of Classification Search ..... None
See application file for complete search history.

(56) References Cited

U.S. PATENT DOCUMENTS

| | | | |
|---|---|---|---|
| 1,045,311 | A | 11/1912 | Moberg |
| 1,532,297 | A | 4/1925 | Bausch et al. |
| 1,588,577 | A | 6/1926 | Heifler |
| 1,664,392 | A | 4/1928 | Baruch |
| 2,382,249 | A | 8/1945 | Megar |
| 2,440,974 | A | 5/1948 | Resch |
| 2,555,205 | A | 5/1951 | Steffens |
| 3,170,652 | A | 2/1965 | Kennedy |
| 3,310,353 | A | 3/1967 | Cordis |
| 3,362,653 | A | 1/1968 | Carlisle |
| 3,368,522 | A | 2/1968 | Cordis |
| 3,523,653 | A | 8/1970 | Hansen |
| 3,532,210 | A | 10/1970 | Minion et al. |
| 3,568,635 | A | 3/1971 | Poitras et al. |
| 3,592,161 | A | 7/1971 | Hoffmann |
| 3,713,170 | A | 1/1973 | Kaufman |
| 3,729,145 | A | 4/1973 | Koo et al. |
| 3,756,483 | A | 9/1973 | Schraeder |
| 3,770,118 | A | 11/1973 | Jones |

(Continued)

FOREIGN PATENT DOCUMENTS

DE 039 38 352 A1 7/1990

(Continued)

OTHER PUBLICATIONS

Derwent World Patent Database abstract of DE 3133237 A: Description of M. Scheepe, "Refill Pack of Moisture-Impregnated Tissues—Are Supplied in Aluminum Foil Packets Lined With Plastics."

*Primary Examiner*—Gene Crawford
*Assistant Examiner*—Timothy R Waggoner
(74) *Attorney, Agent, or Firm*—Judy Garot

(57) ABSTRACT

A co-packaged product and containers for co-packaging two different substrates is disclosed. The co-packaged product comprises a first substrate wound into a roll having an interior space, and a second substrate is located within at least a portion of the interior space. In one embodiment, a paper towel roll has a wet wipe container located within the core of the paper towel.

26 Claims, 3 Drawing Sheets

U.S. PATENT DOCUMENTS

| | | | |
|---|---|---|---|
| 3,775,801 | A | 12/1973 | Walker |
| 3,780,908 | A | 12/1973 | Fitzpatrick et al. |
| 3,784,055 | A | 1/1974 | Anderson |
| 3,794,253 | A | 2/1974 | Megdall |
| 3,795,355 | A | 3/1974 | Gerstein |
| 3,836,044 | A | 9/1974 | Tilp et al. |
| 3,836,045 | A | 9/1974 | Duhy et al. |
| 3,837,595 | A | 9/1974 | Boone |
| 3,841,466 | A | 10/1974 | Hoffman et al. |
| 3,843,017 | A | 10/1974 | Harrison |
| 3,847,722 | A | 11/1974 | Kistner |
| 3,848,822 | A | 11/1974 | Boone |
| 3,890,622 | A | 6/1975 | Alden |
| 3,913,522 | A | 10/1975 | Light |
| 3,949,947 | A | 4/1976 | Youngquist et al. |
| 3,967,756 | A | 7/1976 | Barish |
| 3,970,215 | A | 7/1976 | McLaren et al. |
| 3,973,695 | A | 8/1976 | Ames |
| 3,982,659 | A | 9/1976 | Ross |
| 3,986,479 | A | 10/1976 | Bonk |
| 3,994,417 | A | 11/1976 | Boedecker |
| 3,995,582 | A | 12/1976 | Douglas |
| 4,002,264 | A | 1/1977 | Marchesani |
| 4,004,687 | A | 1/1977 | Boone |
| 4,030,676 | A | 6/1977 | Bardsley |
| 4,058,354 | A | 11/1977 | Powaska |
| 4,069,789 | A | 1/1978 | Fukagawa et al. |
| 4,101,026 | A | 7/1978 | Bonk |
| 4,106,433 | A | 8/1978 | Fernando et al. |
| 4,106,616 | A | 8/1978 | Boone |
| 4,106,617 | A | 8/1978 | Boone |
| 4,135,199 | A | 1/1979 | Kurland et al. |
| 4,138,034 | A | 2/1979 | McCarthy |
| 4,147,441 | A | 4/1979 | Harrison et al. |
| 4,171,047 | A | 10/1979 | Doyle et al. |
| 4,180,160 | A | 12/1979 | Ogawa et al. |
| 4,191,317 | A | 3/1980 | Harkins |
| 4,205,802 | A | 6/1980 | Economakis |
| 4,219,129 | A | 8/1980 | Sedgwick |
| 4,235,333 | A | 11/1980 | Boone |
| 4,260,117 | A | 4/1981 | Perrin et al. |
| 4,274,573 | A | 6/1981 | Finkelstein |
| 4,328,907 | A | 5/1982 | Beard |
| 4,369,929 | A | 1/1983 | Cayer |
| 4,401,248 | A | 8/1983 | Helms |
| 4,411,374 | A | 10/1983 | Hotchkiss |
| 4,436,221 | A | 3/1984 | Margulies |
| 4,436,224 | A | 3/1984 | McInerny |
| 4,453,634 | A | 6/1984 | Blumenthal |
| 4,467,974 | A | 8/1984 | Crim |
| 4,478,354 | A | 10/1984 | Notheis |
| 4,487,376 | A | 12/1984 | Compton |
| 4,516,676 | A | 5/1985 | Cournoyer |
| 4,519,308 | A | 5/1985 | Eberle |
| 4,526,291 | A | 7/1985 | Margulies |
| 4,534,491 | A | 8/1985 | Norton et al. |
| 4,535,912 | A | 8/1985 | Bonk |
| 4,566,606 | A | 1/1986 | Kling |
| 4,570,820 | A | 2/1986 | Murphy |
| 4,651,895 | A | 3/1987 | Niske et al. |
| 4,676,131 | A | 6/1987 | Cassia |
| 4,690,345 | A | 9/1987 | Cotey |
| 4,735,317 | A | 4/1988 | Sussman et al. |
| 4,738,176 | A | 4/1988 | Cassia |
| D297,895 | S | 10/1988 | Mattei |
| D298,597 | S | 11/1988 | Bell |
| 4,784,290 | A | 11/1988 | Howard |
| 4,830,301 | A | 5/1989 | Miller |
| 4,834,316 | A | 5/1989 | DeLorean |
| 4,860,893 | A | 8/1989 | Kaufman |
| D303,890 | S | 10/1989 | Pilot |
| 4,877,133 | A | 10/1989 | Klenter et al. |
| 4,883,197 | A | 11/1989 | Sanchez et al. |
| 4,884,690 | A | 12/1989 | Klenter et al. |
| D306,809 | S | 3/1990 | Joseph |
| 4,936,452 | A | 6/1990 | Pauley |
| D311,106 | S | 10/1990 | Jaber |
| 4,964,526 | A | 10/1990 | Stephens |
| 4,978,095 | A | 12/1990 | Phillips |
| 4,984,530 | A | 1/1991 | Dutton |
| 4,991,538 | A | 2/1991 | Davids et al. |
| 5,050,737 | A | 9/1991 | Joslyn et al. |
| 5,097,998 | A | 3/1992 | Shimasaki |
| 5,104,054 | A | 4/1992 | Latham |
| 5,134,957 | A | 8/1992 | Nobili |
| 5,145,091 | A | 9/1992 | Meyers |
| D329,978 | S | 10/1992 | Ryan |
| 5,170,958 | A | 12/1992 | Brown |
| 5,192,044 | A | 3/1993 | Baskin |
| 5,193,759 | A | 3/1993 | Bigelow et al. |
| 5,195,689 | A | 3/1993 | Beer et al. |
| 5,207,367 | A | 5/1993 | Dunn et al. |
| 5,215,757 | A | 6/1993 | El Nokaly |
| 5,219,092 | A | 6/1993 | Morand |
| 5,228,632 | A | 7/1993 | Addison et al. |
| 5,242,057 | A | 9/1993 | Cook et al. |
| 5,255,861 | A | 10/1993 | Lerner |
| D342,635 | S | 12/1993 | Carter et al. |
| 5,305,937 | A | 4/1994 | Barnett |
| 5,310,262 | A | 5/1994 | Robison et al. |
| 5,311,986 | A | 5/1994 | Putz |
| D347,534 | S | 6/1994 | Gottselig |
| 5,335,811 | A | 8/1994 | Morand |
| 5,346,064 | A | 9/1994 | Rizzuto |
| 5,368,157 | A | 11/1994 | Gasparrini et al. |
| 5,392,945 | A | 2/1995 | Syrek |
| 5,409,181 | A | 4/1995 | Patrick |
| 5,439,521 | A | 8/1995 | Rao |
| 5,452,832 | A | 9/1995 | Niada |
| 5,467,893 | A | 11/1995 | Landis, II et al. |
| 5,473,789 | A | 12/1995 | Oster |
| 5,509,593 | A | 4/1996 | Bloch et al. |
| 5,533,621 | A | 7/1996 | Schoal, Jr. |
| 5,542,566 | A | 8/1996 | Glaug et al. |
| 5,542,568 | A | 8/1996 | Julius |
| D377,284 | S | 1/1997 | Farrow et al. |
| 5,598,987 | A | 2/1997 | Wachowicz |
| 5,599,555 | A | 2/1997 | El Nokaly |
| 5,604,992 | A | 2/1997 | Robinson |
| 5,609,269 | A | 3/1997 | Behnke et al. |
| 5,618,008 | A | 4/1997 | Dearwester et al. |
| 5,630,526 | A | 5/1997 | Moody |
| 5,630,563 | A | 5/1997 | Meisner et al. |
| 5,638,957 | A | 6/1997 | Brasier |
| 5,642,810 | A | 7/1997 | Warner et al. |
| 5,649,676 | A | 7/1997 | Lord |
| 5,651,487 | A | 7/1997 | Hansen |
| D381,851 | S | 8/1997 | Sharpe |
| 5,655,661 | A | 8/1997 | Rigby |
| 5,660,313 | A | 8/1997 | Newbold |
| 5,660,636 | A | 8/1997 | Shangold et al. |
| 5,667,092 | A | 9/1997 | Julius et al. |
| 5,672,206 | A | 9/1997 | Gorman |
| D386,025 | S | 11/1997 | Mervar et al. |
| 5,687,875 | A | 11/1997 | Watts et al. |
| 5,697,577 | A | 12/1997 | Ogden |
| 5,704,566 | A | 1/1998 | Schutz et al. |
| 5,716,920 | A | 2/1998 | Glenn, Jr. et al. |
| D394,177 | S | 5/1998 | Christopher |
| 5,763,984 | A | 6/1998 | Day |
| 5,765,717 | A | 6/1998 | Gottselig |
| 5,785,179 | A | 7/1998 | Buczwinski et al. |
| D397,265 | S | 8/1998 | Badillo |
| 5,803,249 | A | 9/1998 | Harsanyi, Jr. et al. |

| | | | |
|---|---|---|---|
| RE35,976 | E | 12/1998 | Gasparrini et al. |
| 5,848,762 | A | 12/1998 | Reinheimer et al. |
| 5,863,663 | A | 1/1999 | Mackey et al. |
| 5,868,275 | A | 2/1999 | Moody |
| 5,887,759 | A | 3/1999 | Ayigbe |
| 5,897,074 | A | 4/1999 | Marino |
| 5,897,539 | A | 4/1999 | Elliesen et al. |
| 5,904,316 | A | 5/1999 | Dunning et al. |
| D412,439 | S | 8/1999 | Cormack |
| 5,938,013 | A | 8/1999 | Palumbo et al. |
| 5,938,141 | A | 8/1999 | Kanbar |
| 5,950,960 | A | 9/1999 | Marino |
| 5,951,762 | A | 9/1999 | Shangold et al. |
| 5,952,043 | A | 9/1999 | Mackey et al. |
| D416,794 | S | 11/1999 | Cormack |
| D417,109 | S | 11/1999 | Johnson et al. |
| 5,980,931 | A | 11/1999 | Fowler et al. |
| D417,987 | S | 12/1999 | Velazquez |
| 6,001,381 | A | 12/1999 | Gordon et al. |
| 6,003,723 | A | 12/1999 | Morand |
| D421,691 | S | 3/2000 | Hoblitz |
| 6,047,920 | A | 4/2000 | Dearwester et al. |
| 6,056,235 | A | 5/2000 | Brozinsky |
| 6,059,882 | A | 5/2000 | Steinhardt et al. |
| 6,079,305 | A | 6/2000 | Bloch et al. |
| 6,085,899 | A | 7/2000 | Thorsbakken |
| D429,282 | S | 8/2000 | Velazquez et al. |
| 6,098,836 | A | 8/2000 | Gottselig |
| 6,121,165 | A | 9/2000 | Mackey et al. |
| 6,138,867 | A | 10/2000 | Stelmack |
| 6,158,614 | A | 12/2000 | Haines et al. |
| 6,164,442 | A | 12/2000 | Stravitz |
| 6,179,162 | B1 | 1/2001 | Motsenbocker |
| 6,182,290 | B1 | 2/2001 | Morris |
| 6,189,730 | B1 | 2/2001 | McClymonds |
| 6,206,221 | B1 | 3/2001 | Bando et al. |
| 6,213,424 | B1 | 4/2001 | Helfer Grand |
| 6,216,920 | B1 * | 4/2001 | Baggett ..... 242/422.5 |
| 6,270,878 | B1 | 8/2001 | Wegele et al. |
| 6,279,775 | B1 | 8/2001 | Parkes et al. |
| 6,314,971 | B1 | 11/2001 | Schneider |
| 6,318,590 | B1 | 11/2001 | McMurray Stivers |
| 6,321,937 | B1 | 11/2001 | DeSimone et al. |
| 6,346,153 | B1 | 2/2002 | Lake et al. |
| 6,364,101 | B1 | 4/2002 | Schultz |
| D457,765 | S | 5/2002 | Peotter et al. |
| 6,382,552 | B1 | 5/2002 | Paul et al. |
| 6,394,324 | B1 | 5/2002 | Chen |
| 6,405,972 | B1 | 6/2002 | Wakam |
| 6,412,656 | B1 | 7/2002 | Placik |
| 6,427,839 | B1 | 8/2002 | Helfer Grand |
| 6,431,405 | B2 | 8/2002 | Irwin |
| 6,439,386 | B1 | 8/2002 | Sauer et al. |
| 6,446,808 | B1 | 9/2002 | DeWitt et al. |
| 6,503,326 | B1 | 1/2003 | Mikelionis |
| 6,644,563 | B2 * | 11/2003 | Presson ..... 222/192 |
| 6,899,250 | B2 * | 5/2005 | FitzSimons et al. ..... 221/45 |
| 7,293,738 | B2 | 11/2007 | Grébonval et al. |
| 2002/0036208 | A1 | 3/2002 | Faulks et al. |
| 2002/0162848 | A1 | 11/2002 | Na |
| 2004/0120988 | A1 | 6/2004 | Masting |
| 2004/0251265 | A1 | 12/2004 | Fitzsimons et al. |
| 2004/0251292 | A1 | 12/2004 | Grébonval et al. |

FOREIGN PATENT DOCUMENTS

| | | | |
|---|---|---|---|
| DE | 297 11 723 | U1 | 10/1997 |
| DE | 297 19 026 | U1 | 3/1998 |
| DE | 197 16 254 | A1 | 1/1999 |
| DE | 298 12 501 | U1 | 3/1999 |
| DE | 299 01 086 | U1 | 7/1999 |
| DE | 199 37 881 | A1 | 2/2001 |
| EP | 0 122 809 | A1 | 10/1984 |
| EP | 0 251 103 | B1 | 2/1990 |
| EP | 0 193 130 | B1 | 5/1990 |
| EP | 0 235 438 | B1 | 1/1991 |
| EP | 0 119 341 | B1 | 6/1991 |
| EP | 0 501 905 | A1 | 9/1992 |
| EP | 0 420 301 | B1 | 10/1993 |
| EP | 0 368 240 | B1 | 1/1995 |
| EP | 0 858 758 | A1 | 8/1998 |
| EP | 0 750 063 | B1 | 10/1999 |
| EP | 1 048 257 | A2 | 11/2000 |
| EP | 1 059 032 | A1 | 12/2000 |
| EP | 0 789 642 | B1 | 1/2001 |
| EP | 0 836 842 | B1 | 4/2001 |
| EP | 0 865 247 | B1 | 3/2002 |
| GB | 2 252 954 | A | 8/1992 |
| GB | 2 270 901 | A | 3/1994 |
| GB | 2 394 219 | A | 4/2004 |
| WO | WO 91/19663 | A1 | 12/1991 |
| WO | WO 96/21388 | A1 | 7/1996 |
| WO | WO 98/08763 | A1 | 3/1998 |
| WO | WO 99/06311 | A2 | 2/1999 |
| WO | WO 99/29602 | A1 | 6/1999 |
| WO | WO 99/53816 | A1 | 10/1999 |
| WO | WO 01/42117 | A1 | 6/2001 |
| WO | WO 01/64525 | A2 | 9/2001 |
| WO | WO 01/76437 | A1 | 10/2001 |
| WO | WO 01/76438 | A1 | 10/2001 |
| WO | WO 01/76439 | A1 | 10/2001 |
| WO | WO 01/76440 | A1 | 10/2001 |
| WO | WO 01/76443 | A2 | 10/2001 |
| WO | WO 01/82763 | A1 | 11/2001 |
| WO | WO 01/82764 | A1 | 11/2001 |
| WO | WO 01/82765 | A1 | 11/2001 |
| WO | WO 01/83866 | A2 | 11/2001 |
| WO | WO 01/89937 | A2 | 11/2001 |
| WO | WO 02/21988 | A1 | 3/2002 |
| WO | WO 02/21989 | A2 | 3/2002 |
| WO | WO 02/064435 | A2 | 8/2002 |

* cited by examiner

PACKAGING TWO DIFFERENT SUBSTRATES

This application is a divisional application of application Ser. No. 10/324,860 filed on Dec. 20, 2002 now U.S. Pat. No. 7,354,598. The entirety of application Ser. No. 10/324,860 is hereby incorporated by reference.

BACKGROUND

Often substrates are packaged as a roll of individual sheets or as a stack of sheets, which can be folded within the stack if desired. While these packaging formats are useful, a consumer who desires utilizing two different substrates, such as a wet substrate and a dry substrate for cleaning or other purposes, must buy and store two individually packaged products. This often results in one or both of the packages being stored under a counter or in a drawer since insufficient space can prevent both products from being placed in a readily accessible position. Because cleaning is a chore people want it done with as quickly as possible, and they will reach for whatever is readily available. Therefore, if both substrates are not readily available, the stored substrate is often not utilized. Thus, a need exists for a convenient way of packaging and dispensing two different substrates.

SUMMARY

The inventors have found that by placing another substrate within the previously wasted interior space of a roll, such as the interior space of a core, a convenient package for two different substrates results. Thus, in one embodiment, a paper towel roll can have a wet wipes container located within the core of the towel roll occupying the previously unutilized interior space. This allows placement of both substrates on a counter for either dry wiping or wet wiping of surfaces as desired.

Hence, in one aspect the invention resides in a first substrate wound into a roll having an interior space and a rotation axis; a second substrate located within at least a portion of the interior space; and the rotation axis orientated substantially vertical.

In another aspect, the invention resides in a first substrate wound into a roll having an interior space and a rotation axis with the rotation axis orientated substantially vertical; a second substrate at least partially enclosed by a container; and at least a portion of the container located in the interior space.

In another aspect, the invention resides in a container having a cylindrical body, a first end, and a second end; an opening into the container located in the first end; a cap operatively associated with the opening for closing the opening; a second substrate located within the container; and a fastening member located on the second end.

BRIEF DESCRIPTION OF THE DRAWINGS

The above aspects and other features, aspects, and advantages of the present invention will become better understood with regard to the following description, appended claims, and accompanying drawings where:

DEFINITIONS

As used herein forms of "comprise", "have", and "include" are legally equivalent and are open-ended. Therefore, additional non-recited elements, functions, steps, or limitations may be present in addition to the recited elements, functions, steps, or limitations.

As used herein "substrate" is a flexible sheet or web material, which is useful for household chores, personal care, health care, food wrapping, and cosmetic application or removal. A cardboard core of a roll, such as a roll of paper towels or toilet paper, is not a substrate for purposes of the present invention.

Non-limiting examples of suitable substrates of the present invention include nonwoven substrates, woven substrates, hydro-entangled substrates, air-entangled substrates, paper substrates such as tissue, toilet paper, or paper towels, waxed paper substrates, coform substrates, wet wipes, film or plastic substrates such as those used to wrap food, and metal substrates such as aluminum foil. Furthermore, laminated or plied together substrates of two or more layers of any of the preceding substrates are suitable.

Further examples of suitable substrates include a substantially dry substrate (less than 10% by weight of water) containing lathering surfactants and conditioning agents either impregnated into or applied to the substrate such that wetting of the substrate with water prior to use yields a personal cleansing product. Such substrates are disclosed in U.S. Pat. No. 5,980,931 entitled Cleansing Products Having A Substantially Dry Substrate issued to Fowler et al. on Nov. 9, 1999 and herein incorporated by reference in a manner consistent with the present disclosure.

Other suitable substrates may have encapsulated ingredients such that the capsules rupture during dispensing or use. Examples of encapsulated materials include those disclosed in U.S. Pat. Nos. 5,215,757 and 5,599,555 both issued to El-Nokaly and herein incorporated by reference in a manner consistent with the present disclosure.

Other suitable substrates include dry substrates that deliver liquid when subjected to in-use shear and compressive forces. Such substrates are disclosed in U.S. Pat. No. 6,121,165entitled Wet-Like Cleaning Articles issued to Mackey et al. Sep. 19, 2000 and herein incorporated by reference in a manner consistent with the present disclosure.

DETAILED DESCRIPTION

Figure 1:
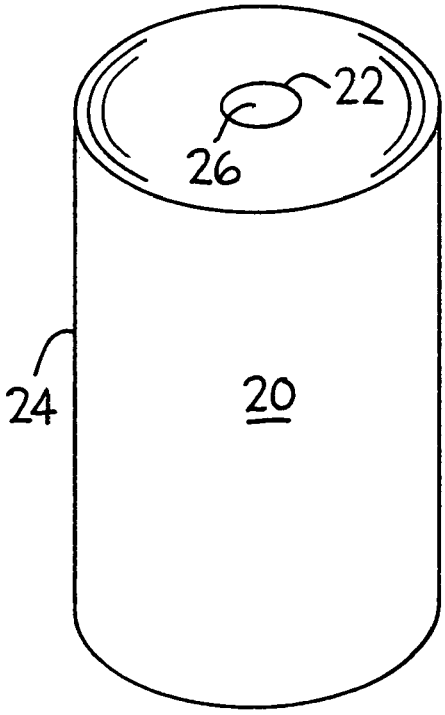
FIG. 1 illustrates a roll of a first substrate.
Figure 2:
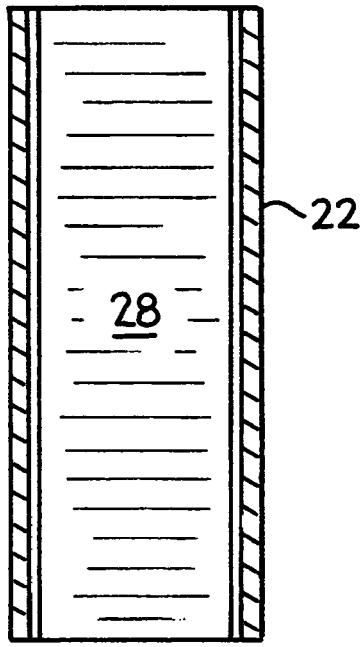
FIG. 2 illustrates a core containing a second substrate.
Figure 3:
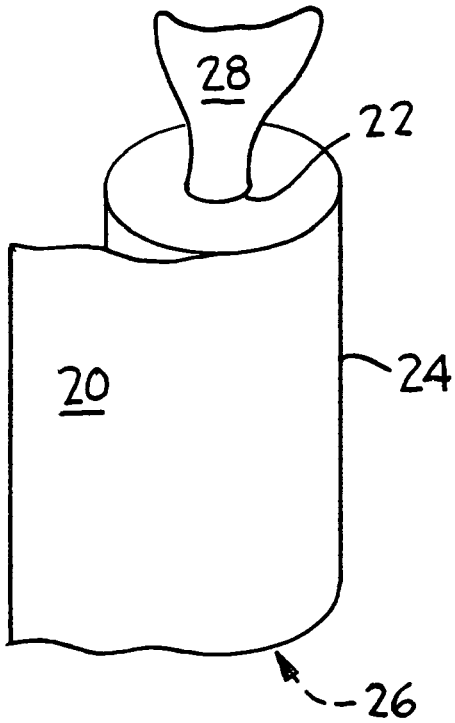
FIG. 3 illustrates a co-packaged first and second substrate.

FIGS. 1-3 illustrate one embodiment of the invention. FIG. 1 depicts a first substrate 20 that is wound around a core 22 into a roll 24. Located within the roll 24 is an interior space 26 that is generally cylindrical. Often the interior space 26 is used when a spindle passes through the roll 24 for rotation of the roll about a rotation axis 23 (FIG. 4) as the first substrate 20 is dispensed. However, instead of a spindle occupying the interior space 26, the interior space contains a second substrate 28 located within the core 22 as illustrated in a cross-section view of the core in FIG. 2. The resulting co-packaged product is illustrated in FIG. 3, with the second substrate 28 located within at least a portion of the interior space 26. The co-packaged product allows for dispensing of the first substrate 20 from the roll's periphery and dispensing of the second substrate 28 from the interior space 26. It is also possible to place the second substrate into a container 30

(FIG. 4), such as a flexible poly-bag or a rigid enclosure, and then locate the container 30 within the interior space.

It should be noted that while FIGS. 1-3 show a core 22, it is possible to eliminate the core 22. For instance, the second substrate 28 can be wound into a roll about a mandrel and then the first substrate 20 wound on top of the second substrate. The result is a roll 24 of the first substrate 20 having another roll of the second substrate 28 located within at least a portion of the interior space 26. Upon removal of the mandrel, the first and second substrates can be individually dispensed as illustrated in FIG. 3. For example, the first substrate 20 can comprise a metal foil and the second substrate 28 can comprise a plastic film.

Figure 4:
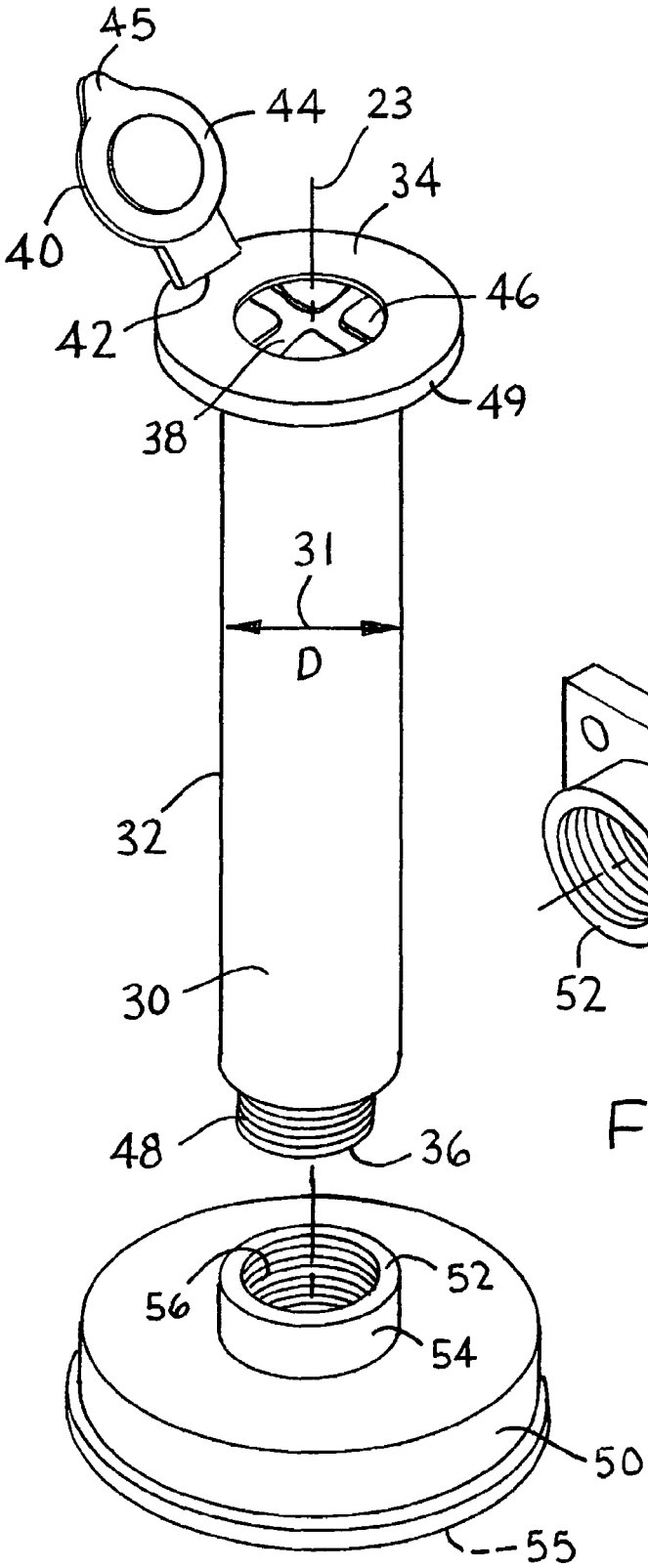
FIG. 4 illustrates a container and a base
Figure 5:
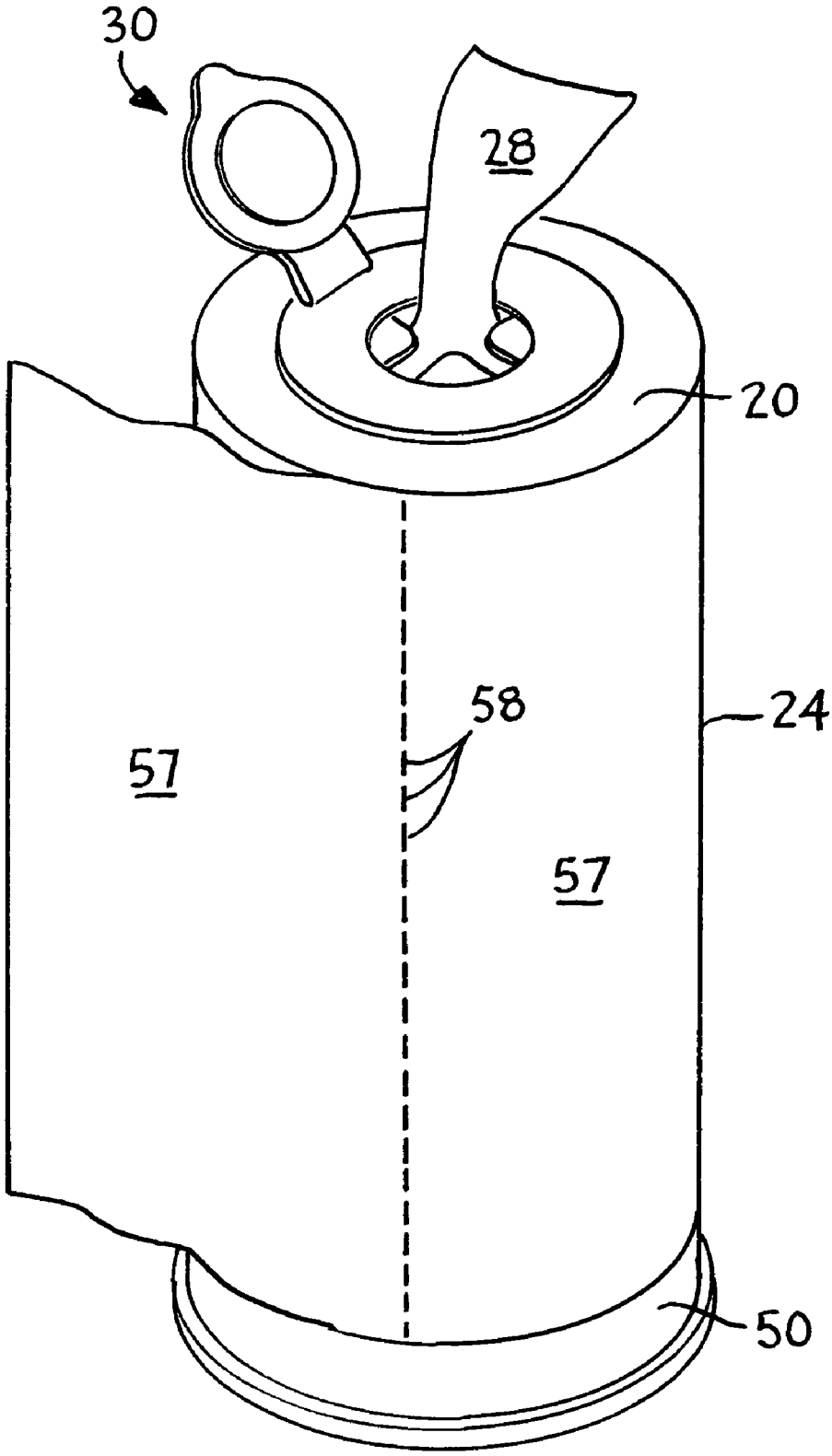
FIG. 5 illustrates another co-packaged first and second substrate.

Referring now to FIGS. 4 and 5 further embodiments of the invention are illustrated. The container 30 houses the second substrate 28. The container has a body 32, a first end 34, and a second end 36. Housed within the container 30 is a second substrate 28, which in one embodiment is a wet wipe suitable for wiping surfaces within the kitchen or bathroom. The container 30 has an opening 38 located in the first end 34 for withdrawing the second substrate 28 from the container's interior.

In one embodiment, the container 30 has a cylindrical body 32 having a diameter (D) 31. The diameter D is sized to allow the container 30 to fit inside the core 22 or the interior space 26 of the roll 24, and to allow the roll to rotate about the container 30 as the first substrate 20 is dispensed. In general, the size of D is governed by one or more of the following factors: the desired amount of the second substrate 28 to be placed into the container 30; the desired amount of the first substrate 20 to be contained in the roll 24; the size of the core 22; the diameter of the roll 24; and the relative usage of the first and second substrates (20, 28). In various embodiments, the size D can be less than about 6 inches (15.2 cm), or D can be less than about 4 inches (10.2 cm), or D can be from about 5 inches (12.7 cm) to about 1 inch (2.5 cm), or D can be from about 4.5 inches (11.4 cm) to about 2 inches (5.1 cm), or D can be from about 3.5 inches (8.9 cm) to about 2 inches (5.1 cm).

A cap 40, located on the first end 34, is operatively associated with the opening 38 to minimize evaporation and drying of any wet substrates placed into the container 30. The cap can include a flexible hinge 42 and a sealing member 44. The sealing member 44 can include a flange on the cap, a gasket, a lip, a protrusion, or other means to prevent air and moisture migration from the container's interior to the environment. The cap can also include an opening flange 45. The opening flange 45 extends from the cap to assist in opening the cap by use of one's thumb or finger. In addition, other caps for the container 30 are possible. Such caps can include a screw cap similar to a soda bottle, a resealable film or foil cap, a plug, or a snap-on cap. In one embodiment, the cap is designed to readily enclose the exposed portion of the second substrate 28 by providing a volume within the cap for enclosing the exposed tail.

The opening 38 can include one or more dispensing flanges 46 located within the opening 38. The function of the dispensing flanges 46 is to assist in the dispensing of the second substrate 28 from the container 30. Such assistance can include preventing the substrate from falling back to within the container's interior, holding the substrate in a convenient position for dispensing, and/or providing resistance for tearing perforated substrates. The dispensing flanges 46 can be made from the same material as the container or made from an alternative material such as a flexible elastomeric or rubber compound. The dispensing flanges can include a hinge or a weakened portion of the flange to enhance their flexibility. The dispensing flange 46 can also comprise a film, foil, elastomeric, or other material with an opening 38. The opening 38 can comprise a slit or cut through the material.

The container 30 includes a fastening member 48 for removable attachment of the container 30 to a base 50. Alternatively, the fastening member 48 can attach the container 30 to a counter, a wall, or other object in addition to the base 50. In the illustrated embodiment, the fastening member 48 is a male thread although the invention is not so limited. The fastening member can include any fastening means known to those of skill in the art for attaching one element (the container) to another element (the base). Such fastening means include without limitation, a location fit of the second end 36 in a bore, a press fit of the second end 36 in a bore, a twist lock using lugs and/or recessed portions to engage the second end 36 with the base; a tab or a slot, a snap fit, adhesives, magnets, and mechanical fasteners such as hook and loop material.

The container 30 can also include a retaining member 49 located on the first end 34. The retaining member 49, in this embodiment, is an integral flange extending past the body 32 preventing the roll 24 from sliding off the container 30. The retaining member 49 can be useful when the roll 24 is orientated in various directions such as when the rotation axis 23 is horizontal rather than vertical as drawn. Other types of integral or separate retaining members are possible such as a pin extending from the body 32, or a ring encircling the body, or a nut threaded onto the first end 34. It is also possible to design the cap 40 to function as the retaining member 49 by making it oversized relative to the body 32 to prevent the roll's removal with the cap attached.

Figure 4A:
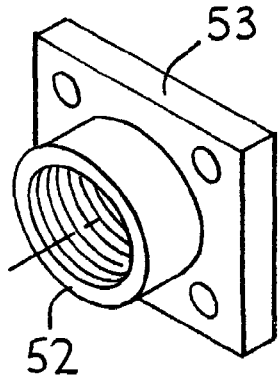
FIG. 4A illustrates an attachment member.

The base 50 can include a securing member 52 that engages the fastening member 48. The securing member 52 and the fastening member 48 are operatively associated with each other to allow the container 30 to be removably attached to the base 50. The base can be weighed and should serve to stabilize the container 30 and the roll 24 when dispensing either substrate. Alternatively, the securing member 52 can be located on an attachment member 53 (FIG. 4A), such as a plate with holes, for attachment of the container 30 to walls, counters, or other objects. The securing member 52 can be selected from the same fastening means as the fastening member 48. In one embodiment, the securing member 52 is located in a cylindrical projection 54 and comprises a female thread 56. The cylindrical projection 54 is useful for locating the core 22 when the roll 24 is placed on the base. The diameter of the cylindrical projection 54 is sized to allow the roll 24 to rotate as the first substrate 20 is dispensed. The base 50 can also include an anti-skid member 55 on a bottom surface, such as an elastomeric material, cork material, fabric material, or adhesive to minimize movement of the base during dispensing and/or to protect surfaces from damage.

FIG. 5 illustrates another embodiment of a co-packaged first and second substrate. At least a portion of the container 30 is placed within the interior space 26 of a paper towel first substrate 20 having a plurality of individual sheets 57 separated by one or more perforations 58 and wound on a core 22. To use the container 30 and the base 50, the roll 24 is placed on the base 50 locating the core 22 about cylindrical projection 54. The roll 24 is located such that the rotation axis 23 is substantially vertical. The container 30 is then inserted into the core 22 and screwed to the base via the fastening member 48 and the securing member 52. Next, the entire product can be located in any convenient location. When a spill or other cleaning occasion occurs, the first substrate 20, such as a paper towel, or the second substrate 28, such as a wet wipe, or both can be dispensed to clean up the mess. Furthermore, each substrate 20 and 28 can be replaced independently of one another when depleted by either replacing the roll 24 or inserting a new container 30 as required.

To further enhance the utility of the container 30 with the roll 24, a refill pack of one or more containers containing a pre-packaged second substrate 28 without the roll 24 can be sold. The refill pack can include instructions, such as written directions and/or graphic depictions, for placing the container 30 into the interior space 26 of the roll 24. In addition, the refill pack may indicate that the containers 30 are suitable for use with a specific manufacturer's brand of the first substrate 20, or with a specific manufacturer's base 50 or attachment member 53. Alternatively, the container 30 and the roll 24 can be sold together with instructions to insert the container into the roll or with the container 30 already placed into the interior space 26 of the roll 24.

The container 30 can be made from any suitable material for housing the second substrate 28. The container can be formed of a flexible material which permits the container to bend and flex with minimal applied forces. Suitable flexible materials can include films of polyethylene, polyester, polypropylene, polyvinyl chloride, polyamide, acetate, cellophane, or metal foils amongst other suitable alternatives. The film can be single layer, a laminate of the above materials, or a laminate with a metal foil layer. Alternatively, the container can be made of a rigid material. Suitable rigid materials can include cardboard, polypropylene, polyethylene, polystyrene, plastic, metal, and glass amongst other suitable alternatives. Alternatively, the container can be a combination of flexible and rigid materials such as a flexible poly-bag bottom attached to a rigid top portion comprising the opening and the cap.

The second substrate 28 in the various embodiments can be packaged in any convenient packaging method within the interior space 26. For instance, the second substrate can be a roll, a roll of individual sheets that are separated by one or more perforations, a roll of overlapped or interleaved sheets, individual sheets, individual folded sheets, or interfolded sheets for pop-up dispensing.

It will be appreciated that the foregoing description, given for the purposes of illustration, is not to be construed as limiting the scope of the invention, which is defined by the claims and all equivalents thereto.

The invention claimed is:

1. A product comprising:

a first flexible sheet material wound on a core having an interior space;

a container located at least partially within the interior space, said container having a body, a first end, and a second end;

an opening into the container located on the first end;

a cap operatively associated with the opening for closing the opening;

a second flexible sheet material located within the container; and a fastening member located on the second end.

2. The product of claim 1 wherein the body comprises a cylindrical body.

3. The product of claim 2 wherein the cylindrical body comprises a diameter D and D is less than about 6 inches.

4. The product of claim 3 wherein D is from about 5 inches to about 1 inch.

5. The product of claim 3 wherein D is from about 4.5 inches to about 2 inches.

6. The product of claim 1 wherein the fastening member is selected from the group consisting of a location fit, a press fit, a screw thread, a twist lock, a tab, a slot, and a snap fit.

7. The product of claim 1 wherein the fastening member comprises a screw thread.

8. The product of claim 1 wherein the fastening member is removably attached to a base.

9. The product of claim 8 wherein the base comprises a securing member engaged with the fastening member.

10. The product of claim 9 wherein the securing member is selected from the group consisting of a location fit, a press fit, a screw thread, a twist lock, a tab, a slot, and a snap fit.

11. The product of claim 9 wherein the securing member is located in a cylindrical projection extending from the base.

12. The product of claim 9 wherein the securing member comprises a screw thread.

13. The product of claim 8 wherein the base includes a bottom surface comprising an anti-skid member.

14. The product of claim 1 wherein the fastening member is removably attached to an attachment member.

15. The product of claim 14 wherein the attachment member comprises a plate with a securing member.

16. The product of claim 1 wherein the first end comprises a retaining member.

17. The product of claim 1 wherein the cap comprises a flexible hinge.

18. The product of claim 1 wherein the cap comprises a sealing member.

19. The product of claim 1 wherein the cap encloses an exposed tail of the second substrate.

20. The product of claim 1 wherein the opening comprises at least one dispensing flange.

21. The product of claim 1 comprising a fastening member removably attached to a base.

22. The product of claim 21 wherein the second flexible sheet material is a wet wipe.

23. The product of claim 21 wherein the fastening member is removably attached to an attachment member.

24. A product comprising:

a dry flexible sheet material wound on a core container, said container having a body, a first end, and a second end;

an opening into the container located on the first end;

a cap operatively associated with the opening for closing the opening;

a second flexible sheet material located within the container; and a fastening member located on the second end.

25. The product of claim 24 wherein the second flexible sheet material is a wet wipe.

26. The product of claim 24 wherein the dry flexible sheet material is a paper towel and the second flexible sheet material is a wet wipe.

* * * * *